United States Patent [19]

Weidig

[11] 4,448,586

[45] May 15, 1984

[54] CORROSION INHIBITOR COMPOSITIONS FOR ALCOHOL-BASE FUELS

[75] Inventor: Charles F. Weidig, Grosse Pointe, Mich.

[73] Assignee: Ethyl Corporation, Richmond, Va.

[21] Appl. No.: 317,573

[22] Filed: Nov. 2, 1981

[51] Int. Cl.[3] ..... C10L 1/18

[52] U.S. Cl. ..... 44/55; 44/62; 44/66; 44/70; 252/396

[58] Field of Search ..... 44/55, 70, 62, 66; 252/396

[56] References Cited

U.S. PATENT DOCUMENTS

| | | | |
|---|---|---|---|
| 3,117,091 | 1/1964 | Staker | 44/70 |
| 3,291,580 | 12/1966 | Malick | 44/53 |
| 4,253,876 | 3/1981 | Godar et al. | 252/392 |
| 4,305,730 | 12/1981 | Davis et al. | 44/53 |

*Primary Examiner*—Charles F. Warren
*Assistant Examiner*—Y. Harris-Smith
*Attorney, Agent, or Firm*—Donald L. Johnson; John F. Sieberth; Joseph D. Odenweller

[57] ABSTRACT

Liquid fuels having anti-corrosion properties for use in internal combustion engines comprising (i) a major fraction of a monohydroxy alkanol having from 1 to about 5 carbon atoms, and (ii) a corrosion inhibiting amount of a mixture of (a) from about 5 to 95 parts of an alkyl or alkenyl succinic acid and an ester formed from that acid, or from a related alkyl or alkenyl succinic acid, and a glycol of 2 to 4 carbon atoms wherein the alkyl or alkenyl groups in the acid and in the ester each contain about 8 to 30 carbon atoms, and (b) from about 95 to 5 parts of at least one polymerized unsaturated aliphatic monocarboxylic acid having about 16 to 18 carbon atoms per molecule.

17 Claims, No Drawings

CORROSION INHIBITOR COMPOSITIONS FOR ALCOHOL-BASE FUELS

BACKGROUND OF THE INVENTION

1. Field of the Invention

This invention relates to novel fuel compositions for use in internal combustion engines, especially spark-ignited internal combustion engines and disel engines. More particularly, this invention relates to alcohol-based fuels such as ethanol having rust inhibiting and/or preventing properties. The invention also is concerned with a process for conferring anti-corrosion properties to alcohol-based fuels.

2. Description of the Prior Art

Alcohols seem to be promising alternatives to the petroleum-based fuels in general use today. For example, it has recently been reported in Brazilian patent application No. P17700392 that alcohols, such as methanol and ethanol, can be substituted for conventional petroleum derived diesel fuel for burning in diesel engines, when used in combination with an ignition accelerator, such as ethyl nitrate or nitrate to the alcohol achieved a level of auto-ignition sufficient to permit the operation of diesel engines on alcohol.

Methanol and ethanol are good alternatives to petroleum-based fuels. Ethanol is an especially good alternative fuel in countries with intense cultivation of sugar cane, mandioca, and other raw materials of vegetable origin, adequate for the production of ethanol, such as Brazil.

Both methanol and ethanol, as well as other lower aliphatic alcohol such as propanol, butanol, and amyl alcohol, are good alternatives to petroleum-based fuels for the following reasons:

(1) They can be stored, transported, and distributed using traditional systems in the traditional manner;

(2) With few changes, present-day engines and their accessories can be adopted to the requirements of alcohol fuels; and (3) As these fuels can be handled in existing systems with limited modifications, the total function as effective corrosion inhibitors in ethanol-gasoline fuel mixtures.

The use of a polar oxygenate such as ethanol as a fuel for internal combustion engines, however, has certain disadvantages. One of these is the creation of corrosion problems both in the logistic chain and in the vehicle itself. In pipelines and storage tanks, rust, which normally would remain on the walls, is loosened by the alcohol and transported through the system. Also, as is commonly known, ethanol has a tendency to pick up water from the environment. That is, it is hygroscopic. When exposed to ethanol containing water, many of the metals and alloys which make up the vehicle fuel distribution system and the vehicle engine can corrode. Specifically, fuel tank terne plate, zinc and aluminum die-cast carburetor and fuel pump parts, brass fittings, steel lines, etc., can corrode when exposed to ethanol-based fuel mixtures. This problem can be remedied to some extent by the use of anhydrous or substantially anhydrous ethanol. However, if the fuel mixture is stored for too long a period of time before use, the anhydrous ethanol will pick up water from the environment and become hydrous or ("wet") ethanol. Corrosion can also be brought about by the presence of trace amounts of acetic acid, acetaldehyde, acetate, and e-butanol in the ethanol which are formed during production of the ethanol via fermentation, and the presence of dissolved mineral salts, such as highly corrosive sodium chloride, which may be picked up by the fuel during production, storage, and transportation.

Thus, there is presently a need for a corrosion inhibitor that will either curb or prevent the corrosion of conventional systems which are used to store and transport commercial ethanol fuel blends and one that will curb or prevent corrosion of the vehicle fuel systems in which these fuels are ultimately used. Further, it is important that the corrosion inhibitor be effective in very small quantities to avoid any adverse effects, such as adding to the gum component of the fuels, etc., as well as to minimize cost. The corrosion inhibitors of the present invention satisfy these needs.

U.S. Pat. No. 2,334,158 discloses an anti-corrosive composition of matter comprising predominately non-gaseous hydrocarbons containing small amounts each of a polycarboxylic acid having at least 16 carbon atoms and a mutual solvent for hydrocarbons and water such as di-ethylene glycol mono alkyl ether or an ethylene glycol mono alkyl ether.

U.S. Pat. No. 2,631,979 discloses a mineral lubricating oil containing dissolved therein 0.1% to 2% of a polymerized linoleic acid which consists essentially of the dimer.

U.S. Pat. No. 2,632,695 discloses a normally liquid, non-lubricating mineral oil fraction containing a minor proportion, sufficient to prevent rusting of ferrous metal surfaces in contact therewith, of an anti-rust agent selected from the group consisting of (1) dimeric acids produced by the condensation of unsaturated, aliphatic monocarboxylic acids having between about 16 and about 18 carbon atoms per molecule, (2) dimeric acids produced by the condensation of hydroxyaliphatic monocarboxylic acids having between about 16 and about 18 carbon atoms per molecule, (3) trimeric acids produced by the condensation of unsaturated, aliphatic monocarboxylic acids having between about 16 and about 18 carbon atoms per molecule, (4) trimeric acids produced by the condensation of hydroxyaliphatic monocarboxylic acids having between about 16 and about 18 carbon atoms per molecule.

U.S. Pat. No. 2,962,443 discloses steam turbine lubricants containing the reaction product of:

(a) an aliphatic hydrocarbon-substituted succinic acid having the structure

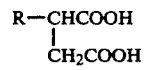

in which R is an aliphatic hydrocarbon radical having at least 10 carbon atoms, with (b) from about 1 to about 75 percent on a molar basis of an alkylene oxide.

Reportedly, the addition of such a product to a steam turbine lubricant comprising a major amount of a mineral oil renders the lubricant resistant to rust and to the formation of stable emulsions.

U.S. Pat. No. 2,993,772 discloses a process for preventing, inhibiting, and modifying the formation of deposits in internal combustion and jet engines employing a substantially hydrocarbon fuel which comprises burning in such engines a fuel consisting of a liquid hydrocarbon having a boiling point up to about 500° F. and a minor amount, in the range of approximately 0.001 to 2%, by weight, of the fuel, sufficient to prevent, inhibit, and modify such deposits, of a member selected from the group consisting of an oil soluble alkenyl succinic acid and the anhydride thereof, having 8 to 31 carbon atoms on the alkenyl group.

U.S. Pat. No. 2,993,773 discloses a process for preventing, inhibiting, and modifying the formation of deposits in internal combustion and jet engines employing a substantially hydrocarbon fuel which comprises burning in such engines a fuel consisting of a liquid hydrocarbon having a boiling point up to about 500° F. and a minor amount, in the range of approximately 0.001 to 2.0 weight percent of said fuel sufficient to prevent, inhibit, and modify such deposits, of an ester of (1) a member selected from the group consisting of an alkenyl succinic acid and the anhydride thereof, having 8 to 31 carbon atoms on the alkenyl group, and (2) an alcohol, said ester being soluble in said liquid hydrocarbon and being composed of only carbon, hydrogen, and oxygen.

U.S. Pat. No. 3,117,091 discloses as rust preventative compounds for a petroleum-based carrier such as motor gasoline, aviation gasoline, jet fuel, turbine oils, and the like, the partial esters of an alkyl or alkenyl succinic anhydride produced by the reaction of one molar equivalent of a polyhydric alcohol with two molar equivalents of the anhydride.

U.S. Pat. No. 3,234,131 relates to lubricants, particularly lubricants comprising lubricating oil, metal salt as a thickener, and a small amount of an alkenyl succinic acid or anhydride, wherein the alkenyl group is preferably a high molecular weight group.

U.S. Pat. No. 3,287,268 discloses the addition to sulfurized and/or chlorinated cutting oils an alkenyl succinic acid ester derivative to reduce the tendency of the oil to produce form and to lessen the stability of the foam that is produced. The alkenyl succinic acid ester derivative employed comprises a mixture of an alkenyl succinic acid and an ester formed from that acid, or from a related alkenyl succinic acid containing about 8 to 30 carbon atoms in the alkenyl group, and a glycol of 2 to 4 carbon atoms.

U.S. Pat. No. 3,288,714 discloses a composition comprising a lubricating oil and from about 0.05% to about 25%, by weight, of alkenyl succinic anhydrides wherein the alkenyl group has a molecular weight of from about 900 to about 2000 and is a polymer of a lower alkene.

U.S. Pat. No. 3,346,354 discloses a hydrocarbon fuel composition capable of reducing intake valve and port deposits which comprises a major proportion of a distillate hydrocarbon mixture boiling substantially in the range of from 100° F. to 750° F. and from 50 to 1000 ppm of a succinic acid derivative selected from the group consisting of (A) an alkenyl succinic acid, (B) an alkenyl succinic ahydride, and (C) an alkenyl succinic ester in which the alkoxy group contains from 1 to 6 carbon atoms wherein the alkenyl groups (A), (B), and (C) contain from 50 to 250 carbon atoms.

U.S. Pat. No. 3,381,022 discloses ester derivatives of a hydrocarbon-substituted succinic acid wherein the hydrocarbon substituent contains at least about 50 aliphatic carbon atoms, the substituent being further characterized by having no more than about 5% olefinic linkages therein based on the total number of carbon-to-carbon covalent linkages in the substituent. The esters include the acidic esters, diesters, and metal salt esters wherein the ester moiety is derived from monohydric and polyhydric alcohols, phenols, and naphthols. These esters are useful as additives in lubricating compositions, fuels, hydrocarbon oils, and power transmitting fluids as well as being plasticizers, detergents, anti-rust agents, and emulsifiers.

U.S. Pat. No. 3,574,574 discloses a motor fuel composition which promotes reduced intake valve and port deposits containing from 0.005 to 0.1 volume percent of a polyester of a polymerized carboxylic acid.

U.S. Pat. No. 3,632,510 discloses lubricating and fuel compositions comprising a major amount of a lubricating oil and a minor proportion of an ester derivative of a hydrocarbon-substituted succinic acid wherein the hydrocarbon substituent contains at least about fifty aliphatic carbon atoms, the substituent being further characterized by having no more than about 5% olefinic linkages therein based on the total number of carbon-to-carbon covalent linkages in the substituent. The esters include the acidic ester, diesters, mixed ester-metal salts, and mixtures of these wherein the ester moiety is derived from monohydric and polyhydric alcohols, phenols, naphthols, and the like.

U.S. Pat. No. 3,687,644 discloses a gasoline composition containing as anti-icing additives 0.00001% to 0.02%, by weight, of a mono- or polycarboxylic acid, or an anhydride, ester, amide, imide thereof; and 0.01% to 5% by weight, of an alcohol, glycol, or polyol. Optionally, an ester of an alkoxylated phenol-aldehyde resin is also present.

U.S. Pat. No. 3,925,030 discloses an anti-icing composition, useful as a gasoline additive, comprising 30–90 weight percent of a gasoline soluble organic compound of the formula Z—OH and 10–70 weight percent of a gasoline soluble polycarboxy hydrocarbon having 25–75 carbon atoms and at least ten carbon atoms per carboxy group, Z containing about 4–180 carbon atoms and being selected from aliphatic hydrocarbyl, hydroxy-aliphatic hydrocarbyl, hydropoly (oxyalkylene), alkyl poly (oxyalkylene) and alkylphenyl poly (oxyalkylene), for example, an anti-icing composition comprising 30–90 weight percent of linoleic acid dimer-trimer acid and 10–70 weight percent of dipropylene glycol.

U.S. Pat. No. 4,002,437 discloses a diesel fuel composition comprising a mixture of hydrocarbons boiling in a range from about 310° to 475° F. containing an additive mixture composed of (1) dimeric and trimeric acids produced by the condensation of unsaturated aliphatic monocarboxylic acids having between about 16 and about 18 carbon atoms per molecule, and hydroxy-aliphatic monocarboxylic acids having between about 16 and 18 carbon atoms per molecule, and hydroxy-aliphatic monocarboxylic acids having between 16 and 18 carbon atoms per molecule, (2) a normally liquid completely or partially neutral amine salt of an oxo-alkyl acid ester of ortho-phosphoric acid in which each esterifying oxo-alkyl group contains 13 to 16 carbon atoms and the amine is an aliphatic hydrocarbon monoamine of 16 to 24 carbon atoms in which each aliphatic hydrocarbon radical is attached to the nitrogen through a saturated carbon atom, (3) an aliphatic demulsifier consisting of fatty acids alkoxylated by a mixture of ethylene and propylene oxides, and (4) a saturated hydrocarbon solvent.

U.S. Pat. No. 4,128,403 discloses a fuel additive having improved rust-inhibiting properties comprising (1) from 5 to 50 weight percent of a hydrocarbyl amine containing at least 1 hydrocarbyl group having a molecular weight between about 300 and 5000, (2) from 0.1 to 10 weight percent of a $C_{12}$ to $C_{30}$ hydrocarbyl succinic acid or anhydride, (3) from 0.1 to 10 weight percent of a demulsifier, and (4) 40 to 90 weight percent of an inert hydrocarbon solvent. A gasoline composition is also disclosed containing from 50 to 400 ppm of the above-identified fuel additive.

U.S. Pat. No. 4,141,693 discloses gasoline containing an added manganese compound to improve the octane rating of the gasoline and including a small amount of an additive selected from a group consisting of a monocarboxylic acid or its ester, a dicarboxylic acid or its monoester or diester, an alkylamine, a substituted phenol or mixture thereof.

U.S. Pat. No. 4,148,605 discloses novel dicarboxylic ester-acids resulting from the condensation of an alkenyl-succinic anhydride with an aliphatic hydroxy acid having from 2 to about 18 carbon atoms and amine salts of said ester-acid as rust or corrosion inhibitors in organic compositions.

U.S. Pat. No. 4,175,927 discloses exhaust hydrocarbon emissions of an internal combustion engine being operating on gasoline containing a cyclopentadienyl manganese antiknock are reduced by the addition of a dimer or a trimer acid or mixture of a dimer and a trimer acid produced by the polymerization or condensation of an unsaturated aliphatic monocarboxylic acid having between 16 and 18 carbon atoms per molecule to the gasoline.

U.S. Pat. No. 4,177,768 discloses an anti-wear compression ignition fuel for use in diesel engines comprising (1) a monohydroxy alkanol having from 1 to 5 carbon atoms, (2) an ignition accelerator, and (3) a wear inhibiting amount of a dimerized unsaturated fatty acid and an ester of a phosphorus acid.

U.S. Pat. No. 4,185,594 discloses an anti-wear compression ignition fuel for use in diesel engines comprising (1) a monohydroxy alkanol having from 1 to 5 carbon atoms, (2) an ignition accelerator, and (3) a wear inhibiting amount of a dimerized unsaturated fatty acid.

U.S. Pat. No. 4,207,076 discloses crude ethyl-t-butyl ether used as a cosolvent for hydrous ethanol in gasoline fuel mixtures. The ether solubilizes grain alcohol in all proportions in low aromatic content gasolines.

U.S. Pat. No. 4,207,077 discloses pure methyl-t-butyl ether used as a cosolvent for hydrous ethanol in gasoline fuel mixtures. The ether solubilizes grain alcohol in all proportions in low aromatic content gasolines.

U.S. Pat. No. 4,214,876 discloses improved corrosion inhibitor compositions for hydrocarbon fuels consisting of mixtures of (a) about 75 to 95 weight percent of a polymerized unsaturated aliphatic monocarboxylic acid having about 16 to 18 carbons, and (b) about 5 to 25 weight percent of a monoalkenyl-succinic acid wherein the alkenyl group has 8 to 18 carbons. Also described are concentrates of the above compositions in hydrocarbon solvents, as well as fuels containing the compositions.

U.S. Pat. No. 4,227,889 discloses an anti-wear compression ignition fuel composition for use in diesel engines comprising (1) from about 70 percent, by weight, to about 98.45 percent, by weight, of a monohydroxy alkanol having from 1–5 carbon atoms, (2) from about 1 percent, by weight, to about 25 percent, by weight, of a fuel oil boiling above the gasoline boiling range, and (3) a wear inhibiting amount of a dimerized unsaturated fatty acid. Optionally, said fuel composition may also contain an ignition accelerator such as an organic nitrate.

U.S. Pat. No. 4,242,099 discloses an anti-wear compression ignition fuel for use in diesel engines comprising (1) a monohydroxy alkanol having from 1 to 5 carbon atoms, and (2) a wear inhibiting amount of a $C_{12}$ to $C_{30}$ hydrocarbyl succinic acid or anhydride, e.g., tetrapropenyl succinic acid. Optionally, said fuel composition may also contain an ignition accelerator such as an organic nitrate.

U.S. Pat. No. 4,248,182 discloses an anti-wear compression ignition fuel for use in diesel engines comprising (1) a monohydroxy alkanol having from 1 to 5 carbon atoms, and (2) a wear inhibiting amount of a $C_8$ to $C_{20}$ aliphatic monocarboxylic acid. Optionally, said fuel composition may also contain an ignition accelerator such as an organic nitrate.

SUMMARY OF THE INVENTION

This invention is a fuel comprising a major amount of a monohydroxy alkanol having from 1 to about 5 carbon atoms, and a corrosion inhibiting amount of a mixture of (a) from about 5 to 95 parts of an alkyl or alkenyl succinic acid ester derivative, and (b) from about 95 to 5 parts of at least one polymerized unsaturated aliphatic monocarboxylic acid having about 16 to 18 carbon atoms per molecule.

In accordance with the present invention, from about 1.0 to 100 ppm of the corrosion inhibiting compositions of the present invention are blended with a fuel consisting predominantly of a monohydroxy alkanol having from 1 to about 5 carbon atoms.

Processwise, the invention resides in blending, using suitable mixing equipment, a monohydroxy alkanol having from 1 to about 5 carbon atoms and the corrosion inhibiting compositions of the present invention in the above given proportions.

As shown below, the addition of a mixture of the aforedescribed corrosion inhibiting components of the present invention to an alcohol-based fuel imparts anti-corrosion properties to the fuel.

DESCRIPTION OF THE PREFERRED EMBODIMENTS

Thus, a preferred embodiment of the present invention is a liquid fuel for use in internal combustion engines comprising a major amount of a monohydroxy alkanol having from 1 to about 5 carbon atoms, and a corrosion inhibiting amount of a mixture of (a) from about 5 to 95 parts of an alkyl or alkenyl succinic acid and the ester of an alkyl or alkenyl succinic acid and a glycol containing 2 to 4 carbon atoms wherein the alkyl and alkenyl groups in said acid and in said ester each contain about 8 to 30 carbon atoms, and (b) from about 95 to 5 parts of at least one polymerized unsaturated aliphatic monocarboxylic acid having from about 16 to 18 carbon atoms per molecule.

Another embodiment of the present invention is a process for conferring anti-corrosion properties to an alcohol-based fuel which comprises adding to a fuel comprising a major amount of a monohydroxy alkanol having from 1 to about 5 carbon atoms, a corrosion inhibiting amount of a mixture of (a) from about 5 to 95 parts of an alkyl or alkenyl succinic acid and the ester of an alkyl or alkenyl succinic acid and a glycol containing 2 to 4 carbon atoms wherein the alkyl and alkenyl groups in said acid and said ester each contain about 8 to 30 carbon atoms, and (b) from about 95 to 5 parts of at least one polymerized unsaturated monocarboxylic acid having about 16 to 18 carbon atoms per molecule.

COMPONENT (a)

The alkyl or alkenyl succinic acid ester derivatives contemplated to be employed herein comprise a mixture of an alkyl or alkenyl succinic acid and an ester formed from that acid or from a related alkyl or alkenyl succinic acid containing about 8 to 30 carbon atoms in the alkyl or alkenyl group, and a glycol of 2 to 4 carbon atoms.

In most cases, primarily because of economic reasons, alkenyl substituted acids are used in lieu of alkyl substituted succinic acids.

The mixture of acids and esters may be prepared by reacting an alkenyl succinic anhydride with about an equimolar quantity of a glycol at a temperature of about 25° C. to about 150° C., for about 1 to 24 hours, followed by the addition of an additional quantity of the same or a related alkenyl succinic anhydride and about an equimolar quantity of water. Alternatively, the mixture of acid and ester may be prepared by reacting together two molar equivalents of the anhydride with one molar equivalent of polyhydric alcohol and one molar equivalent of water. Although not required, a suitable catalyst such as ethylene diamine may be used to reduce reaction time. These preparations may, if desired, be carried out in a mineral oil diluent.

The preparation of alkenyl succinic anhydrides is well known in the art and simply involves the reaction of maleic anhydride with an olefinic compound, usually in equimolar proportions, though in the some cases somewhat of an excess of olefinic material is used. Generally, the reaction involves simple heating, but in other cases catalytic means may be employed. If it is so desired the alkenyl succinic acid or anhydride can be converted to the corresponding alkyl substituted succinic acid compound by hydrogenation and this hydrogenated product can be used to prepare the corrosion inhibiting additives of the present invention.

Since relatively pure olefins are difficult to obtain or are often too expensive for commercial use, alkenyl succinic acid anhydrides are ordinarily prepared as mixtures by reacting mixed olefins with maleic anhydride. Such mixtures, as well as relatively pure alkenyl succinic anhydrides may be employed in this invention. Mixed alkenyl succinic anhydrides wherein the alkenyl group averages 6 to 8, 8 to 10, and 10 to 12 carbon atoms, are commercially available.

Alkenyl succinic anhydrides can also be prepared by reaction of low molecular weight polymers of $C_2$ to $C_4$ olefins with maleic anhydride. Thus, a $C_{12}$ or a $C_{16}$ alkenyl succinic anhydride can be prepared in this manner from tetrapropylene or from tetraisobutylene, respectively.

While the preferred derivative is the hereinafter described mixture of tetrapropenyl succinic acid and the mono- and/or di-ester of said acid with propylene glycol, other alkenyl succinic acid derivatives as well as other methods of preparation may be used. (By tetrapropenyl is meant the $C_{12}$ alkyl group derived from tetrapropylene). For example, the ester may be prepared using $C_2$–$C_4$ glycols, such as ethylene glycol, or butylene glycol; the acid may be any alkenyl succinic acid wherein the alkenyl group contains from about 8 to 30 carbon atoms, for example, $C_8$ from diisobutylene, $C_9$ from tripropylene, $C_{15}$ from pentapropylene, $C_{20}$ to $C_{24}$ from polyisobutylene of about 300 molecular weight, etc.; the relative proportions of said acid and said ester may vary widely but will usually range from about 40 to 80 volume percent acid and 20 to 60 volume percent ester. In addition, the derivative may be prepared with or without the use of a petroleum diluent. Thus, the amount of diluent may also vary widely, for example, from about 0 to 80 weight percent, preferably from about 30 to 50 weight percent.

The derivative may be prepared from two different alkenyl succinic acids, for example, the free acid may be diisobutylene succinic acid and the monoester may be prepared from butylene glycol and tripropylene succinic acid. An ester containing terminal hydroxy groups may be prepared by reacting about equimolar quantities of the alkenyl succinic acid with an alkylene oxide, propylene oxide, or butylene oxide.

The alkenyl succinic acid ester derivative preferred for use in the present alcohol-based fuels of the present invention and referred to above can be prepared by reacting about 0.564 mole of tetrapropenyl succinic anhydride in mineral oil with about 0.282 mole of propylene glycol and 0.282 mole water at a temperature of about 25° C. to 150° C., preferably, 100° C. to 120° C. for about 1 to 24 hours, preferably 1 to 3 hours.

COMPONENT (b)

The polymerized unsaturated aliphatic monocarboxylic acids contemplated to the employed herein are those prepared from the corresponding monocarboxylic acids by methods which are well known in the art. As will be appreciated by those skilled in the art, such polymerized acids generally contain 75% or more of dimer, trimer, and higher polymerized acids and 25% or less of unpolymerized monocarboxylic acid.

For convenience, the "polymerized unsaturated aliphatic monocarboxylic acid having about 16 to 18 carbons" may be referred to as "Component (b)". It will be understood that the expression, "Component (b)", encompasses a mixture of monocarboxylic acid, dimer, trimer, and higher polymerized acids as explained more fully heretofore and hereafter.

The products prepared by polymerization of unsaturated aliphatic monocarboxylic acids are sometimes referred to as "dimer acids" or "trimer acids" in the art. Such expressions are derived from the character of the major component of the polymerized product, i.e., dimer acids or trimer acids. The so-called dimer and trimer acids of the art are encompassed by the expression "Component (b)" employed herein. The term "dimer acid" may be employed hereafter to refer to "Component (b)" acid in which the dimer acid is the major constituent.

Descriptions of the preparation and properties of dimer and trimer acids can be found in the Journal of the American Oil Chemists' Society 24, 65 to 68 (1947); and in U.S. Pat. Nos. 2,482,761; 2,631,979; 2,632,695; and 2,794,782. As shown in the art, dimer acids can be prepared by heating under pressure an unsaturated fatty acid in the presence of a small amount of water at a temperature of 260° to 360° C. for 3 to 8 hours. The dimer acid thus produced usually also contains some unpolymerized monocarboxylic acid, some trimer acid, and some higher polymerized acids. If desired, the amount of the trimer acids can be increased by varying the reaction conditions.

Commercially available dimer acids include "Empol" Dimer Acids (Emery Industries). They are prepared by polymerizing linoleic acids, and contain from 40% to 95% of dimer acids and from 4% to 25% of trimer acids. Commercial trimer acids include "Empol" Trimer Acids which contain from 40% to 95% of trimer acids and from 5% to 25% of dimer acids. Both types of compositions can contain up to 25% of monocarboxylic acids.

Because of their availability and low cost, mixtures of fatty acids called "tall oil fatty acids" are often used to produce dimer and trimer acid compositions. Polymerized tall oil fatty acids, such as "Century ®D-75" (Union Camp Corporation, Chemical Division, P. O. Box 6170, Jacksonville, Fla. 32205) can be used to prepare the composition of this invention. A typical analysis of "Century ®D-75" (in weight percentage) is as follows:

| | |
|---|---|
| Acid Value | 148 |
| Unsaponifiables, % | 2 |
| Viscosity, SSU, 97° C. (210° F.) | 350 |
| Moisture, % | 0.1 |
| Iodine Value | 35 |
| Saponification Value | 173 |
| Monomers, % | 11 |
| Dimer, % | 45 |
| Trimer or greater, % | 44 |

As set forth above, the corrosion inhibiting compositions of the present invention may contain from about 5 to 95 parts of component (a) and from about 95 to 5 parts of component (b). Especially preferred compositions contain approximately 1.0 to 1.5 parts of component (a) and approximately 6 parts of component (b).

Monohydroxy alcohols which can be used in the present invention include those containing from 1 to about 5 carbon atoms. Preferred alcohols are saturated aliphatic monohydric alcohols having from 1 to about 5 carbon atoms. Mehthanol, ethanol, propanol, n-butanol, isobutanol, t-butyl alcohol, amyl alcohol, and isoamyl alcohol are preferred for use in the present invention. Of them, ethanol is the most preferred.

Other additives may be used in formulating the fuel compositions of the present invention. Those compounds may include demulsifying agents, antioxidants, dyes, process oil, benzene, ignition accelerators, and the like, provided they do not adversely effect the anti-corrosive effect of the corrosion inhibiting additives of the invention.

Conventional blending equipment and techniques may be used in preparing the fuel compositions of the present invention. In general, a homogeneous blend of the foregoing active components is achieved merely by blending components (a) and (b), either separately or combined, with the monohydroxy alkanol and any of the other desired above-described components, in a determined proportion sufficient to reduce the corrosion causing tendencies of the fuels. This is normally carried out at ambient temperature.

The preferred ethanol blending component of the present fuel mixtures can be either anhydrous or hydrous ethanol. That is, either 200 proof ethanol or hydrous (or "wet") ethanol containing up to about 25 volume percent water can be blended with the anti-corrosion compound components of the fuel mixtures of this invention. Normally, 190 proof ethanol (95 volume percent ethanol +5 volume percent water) is used as the alcohol component of the fuel. The amount of ethanol which can be present in the fuel mixtures of the present invention can be essentially 100% by volume when anhydrous ethanol is used, but can be as low as about 75% by volume ethanol with the balance of the fuel component being comprised of water.

While the foregoing disclosure has thus far illustrated the invention mainly by reference to the use of ethanol as the alcohol blending agent or component of the fuel mixture, it is to be understood that ethanol can be replaced in the present fuel mixtures with other suitable alcohol blending agents such as methanol, propanol, n-butanol, isobutanol, t-butyl alcohol, and amyl alcohol as previously described in approximately the same amounts by volume as ethanol.

As set forth above, from about 1.0 to about 100 ppm, and preferably from about 5 to 50 ppm, of the corrosion inhibiting compositions of the present invention are blended with the alcohol component of the fuel.

The corrosion inhibiting compounds of the present invention also can be conveniently utilized as concentrates, that is, as concentrated solutions in suitable solvents. When used as a concentrate the additive composition will contain about 35% to 85%, by weight, of a mixture of corrosion inhibiting components (a) and (b) in the amounts set forth herein above and about 65% to 15%, by weight, of a solvent. A preferred concentrate will have about 60% to 80%, by weight, of the corrosion inhibiting compositions of the present invention, and about 20% to 40%, by weight, of solvent. A most preferred concentrate will have about 65% to 75%, by weight, of corrosion inhibiting composition and about 25% to 35%, by weight, of solvent. Suitable solvents can be normally liquid organic compounds boiling in the hydrocarbon fuel boiling range and may include hexane, cyclohexane, heptane, octane, isooctane, benzene, toluene, xylene, aromatic naptha, gasolines, mineral oil, and the like. Mixtures of solvents also can be used. Preferred solvents are mineral oil, xylene, and aromatic naptha.

Thus, another embodiment of the present invention is a corrosion inhibitor concentrate comprising about 35% to 85%, by weight, of a mixture of (a) from about 5 to 95 parts of an alkyl or alkenyl succinic acid and the ester of an alkyl or alkenyl succinic acid and a glycol containing 2 to 4 carbon atoms wherein the alkyl and alkenyl groups in said acid and in said ester each contain about 8 to 30 carbon atoms and at least one normally liquid hydrocarbon (b) from about 95 to 5 parts of at least one polymerized unsaturated monocarboxylic acid having from about 16 to 18 carbon atoms per molecule, and (c) from about 65% to about 15%, by weight, of at least one normally liquid hydrocarbon.

Obviously, many modifications and variations of the invention hereinbefore set forth may be made without departing from the spirit and scope thereof and therefore only such limitations should be imposed thereon as are indicated in the appended claims.

The following examples illustrate the invention.

EXAMPLE I

Preparation Of An Alkenyl Succinic Acid Ester Derivative Compound For Use As A Corrosion Inhibitor Component In An Alcohol Fuel A three-neck, 500 ml., round-bottom flask was charged with tetrapropenylsuccinic anhydride (150.0 grams; 0.564 mole), 1,2-propanediol (21.5 grams; 0.282 mole), water (5.08 grams; 0.282 mole), mineral oil (76.4 grams) and ethylene diamine (0.5 gram). The reaction flask was equipped with an overhead stirrer, a water-cooled condenser, a thermometer with attached temperature controlling device, and a heating mantle. The stirred reaction mixture was heated to 120° C. and held for one hour. The infra-red spectrum of an aliquot of the reaction mixture indicated that all of the anhydride reacted. The acid number of the final product was in the range of 165–195 mgKOH/g. sample.

EXAMPLE II

Anti-Corrosion Evaluation Tests

Various fuel blends were compared for anti-rust performance using a rust inhibiting composition representative of those disclosed herein. Test fuels were prepared using a Brazilian type of alcohol fuel simulated from anhydrous ethanol contaminated with 10 volume percent water, 100 ppm acetic acid, 10 ppm of $Cl^-$ as NaCl, and an anti-corrosion composition of the invention. Comparisons were made between ethanol fuels containing no corrosion inhibitor and ethanol fuels containing a corrosion inhibiting composition representative of those disclosed herein comprising a mixture of about 2 PTB (lb/1000 bbl) of the composition prepared in accordance with the procedure set forth in Example I and about 9.0 PTB of a polymerized monocarboxylic acid designated "Union Camp Century ®D-75", obtained commercially from the Union Camp Corporation, Chemical Division, P.O. Box 6170, Jacksonville, Fla., 32205, described above. The anhydrous ethanol, designated Union Carbide Synasol Solvent, was obtained commercially from the Union Carbide Co. It was prepared from 100 gallons of anhydrous Specially Denatured No. 1 ethanol (100 gallons of ethanol denatured with 5 gallons of methanol) denatured with 1 gallon of methyl isobutyl ketone, 1 gallon ethylacetate (87–89%), and 1 gallon aviation gasoline.

The test fuels were prepared by blending several samples of contaminated hydrous ethanol with the aforedescribed anti-corrosion composition. After the test fuels were blended, they were added to individual 8.0 oz. glass screw-capped bottles in 100 ml. amounts. Samples of control fuels were prepared using the contaminated hydrous ethanol to which no corrosion inhibiting additives were added. The control fuels also were placed in individual 8.0 oz. glass screw-capped bottles in 100 ml. amounts.

Weighed metal coupons (approximately $\frac{3}{4}'' \times 4'' \times 1/32'' - \frac{1}{8}''$) representative of those metals common to vehicle distribution systems and vehicle engines were inserted into the glass bottles containing the test fuels. The following metals, identified by Unified Designation No., as reported in the *Unified Numbering System for Metals and Alloys,* 2nd ed., Warrendale, Pa., Society of Automotive Engineers, 1977, were selected for anti-rust evaluation:

1. Steel, mild carbon, (Unified Designation G10200). Used in tanks and vehicle fuel lines.
2. Zinc casting alloy, (Unified Designation Z35531). Used in carburetors and fuel pumps.
3. Ninety percent lead-10% tin alloy used widely on terne plate, (Unified Designation L05100). Used in vehicle fuel tanks.

The bottles and contents were then stored at 43° C. for a pre-determined time (14 days). During this time, the fuels were changed 10 times. That is, at the end of each day, excluding weekend days, the bottles were emptied of their fuel contents and a fresh sample of the particular fuel being tested was added to the bottle. At the end of 14 days, the coupons were removed from the bottles and their condition observed and recorded. The coupons were then cleaned of corrosion product by established, non-corroding chemical procedures (boiling 20% sodium hydroxide and zinc dust for steel; saturated ammonium acetate solution at room temperature for zinc alloy; and hot concentrated ammonium acetate solution for lead-tin metal alloy). The cleaned coupon was then washed with distilled water, dried, and weighed. The weight loss was taken as a measure of corrosion. The results of these tests are set forth in the following table:

TABLE I

14-DAY CORROSION INHIBITING TESTS

| Inhibitor Composition | Weight Loss, mg. | % Reduction in Weight Loss |
|---|---|---|
| STEEL | | |
| Control Fuel (No Inhibitor) | 194 | |
| Control Fuel + 2.0 PTB of Example I Composition + 9.0 PTB Tall Oil Dimer Acid | 1.5 | 99 |
| ZINC ALLOY | | |
| Control Fuel (No Inhibitor) | 122 | |
| Control Fuel + 2.0 PTB of Example I Composition + 9.0 PTB Tall Oil Dimer Acid | 7.6 | 94 |
| LEAD-TIN ALLOY | | |
| Control Fuel (No Inhibitor) | 24.1 | |
| Control Fuel + 2.0 PTB of Example I Composition + 9.0 PTB Tall Oil Dimer Acid | 8.8 | 63 |

The results summarized in Table I demonstrate that the two component corrosion inhibitor additives of the present invention are effective corrosion inhibitors in alcohol-based fuels at very low concentrations. The results show that the metals and metal alloys exposed to fuels containing the corrosion inhibitors of the invention exhibited a significant reduction in weight loss when compared to like metals and metal alloys exposed to the same fuel blends containing no corrosion inhibitors.

I claim:

1. A liquid fuel for use in internal combustion engines comprising a major amount of a monohydroxy alkanol having from 1 to about 5 carbon atoms and a corrosion inhibiting amount of a mixture consisting essentially of (a) from about 5 to 95 parts of a mixture consisting essentially of 40 to 80 volume percent alkyl or alkenyl succinic acid and 20 to 60 volume percent of an ester of an alkyl or alkenyl succinic acid and a glycol containing 2 to 4 carbon atoms; wherein the alkyl and alkenyl groups in said acid and in said ester each contain about 8 to 30 carbon atoms, and (b) from about 95 to 5 parts of at least one polymerized unsaturated aliphatic monocarboxylic acid having about 16 to 18 carbon atoms per molecule.

2. The fuel of claim 1 wherein said alkanol is anhydrous or substantially anhydrous ethanol.

3. The fuel of claim 1 wherein said alkanol is hydrous ethanol.

4. The fuel of claim 3 wherein said ethanol contains up to about 25 volume percent water.

5. The fuel of claim 1 wherein said alkenyl succinic acid is tetrapropenyl succinic acid and said glycol is propylene glycol.

6. The fuel of claim 1 wherein the polymerized unsaturated aliphatic monocarboxylic acid is polymerized tall oil fatty acid.

7. The fuel of claim 1 wherein the polymerized unsaturated aliphatic monocarboxylic acid is oleic acid.

8. The fuel of claim 1 wherein the polymerized unsaturated aliphatic monocarboxylic acid is linoleic acid.

9. The fuel of claim 1 wherein said mixture of components (a) and (b) is present in an amount of from about 1 to 100 ppm.

10. A corrosion inhibitor concentrate for use in an alcohol-based fuel said concentrate consisting essentially of from about 35% to about 85%, by weight, of a mixture of (a) from about 5 to 95 parts of a mixture consisting essentially of 40 to 80 volume percent alkyl or alkenyl succinic acid and 20 to 60 volume percent of an ester of an alkyl or alkenyl succinic acid and a glycol containing 2 to 4 carbon atoms wherein the alkyl and alkenyl groups in said acid and said ester each contains about 8 to 30 carbon atoms, and (b) from about 95 to 5 parts of at least one polymerized unsaturated aliphatic monocarboxylic acid having about 16 to 18 carbon atoms per molecule, and from about 65% to 15%, by weight, of (c) at least one normally liquid hydrocarbon solvent.

11. A concentrate of claim 10 wherein the polymerized unsaturated aliphatic monocarboxylic acid is polymerized tall oil fatty acid.

12. A concentrate of claim 10 wherein the polymerized unsaturated aliphatic monocarboxylic acid is oleic acid.

13. A concentrate of claim 10 wherein the polymerized unsaturated aliphatic monocarboxylic acid is linoleic acid.

14. A concentrate of claim 10 wherein said succinic acid is tetrapropenyl succinic acid and said glycol is propylene glycol.

15. A concentrate of claim 10 wherein said hydrocarbon solvent is mineral oil.

16. A concentrate of claim 10 wherein said hydrocarbon solvent is xylene.

17. A concentrate of claim 10 wherein said hydrocarbon solvent is aromatic naphtha.

* * * * *

UNITED STATES PATENT AND TRADEMARK OFFICE

CERTIFICATE OF CORRECTION

PATENT NO. : 4,448,586

DATED : May 15, 1984

INVENTOR(S) : CHARLES F. WEIDIG

It is certified that error appears in the above-identified patent and that said Letters Patent is hereby corrected as shown below:

Column 1, line 9, reads "disel", should read --diesel--.

Column 1, line 23, reads "nitrate or nitrate", should read --nitrate or nitrite--.

Column 1, line 67, reads "e-butanol", should read --n-butanol--.

Column 3, line 36, reads "form", should read --foam--.

Column 9, line 36, reads "mehthanol", should read --methanol--.

Title reads "CORROSION INHIBITOR COMPOSITIONS FOR ALCOHOL-BASE FUELS", should read --CORROSION INHIBITOR COMPOSITIONS FOR ALCOHOL-BASED FUELS--.

Signed and Sealed this

*Ninth* Day of *October 1984*

[SEAL]

*Attest:*

GERALD J. MOSSINGHOFF

*Attesting Officer*

*Commissioner of Patents and Trademarks*